United States Patent [19]

Harris

[11] 4,167,350

[45] Sep. 11, 1979

[54] WRITING INSTRUMENT

[75] Inventor: Robert L. Harris, North Scituate, R.I.

[73] Assignee: A. T. Cross Company, Lincoln, R.I.

[21] Appl. No.: 796,014

[22] Filed: May 11, 1977

[51] Int. Cl.[2] ..... B43K 2/00

[52] U.S. Cl. ..... 401/260; 401/54

[58] Field of Search ..... 401/132, 133, 134, 135, 401/198, 199, 208, 217, 213, 280, 83, 54, 216, 117, 260

[56] References Cited

U.S. PATENT DOCUMENTS

| | | | |
|---|---|---|---|
| 365,747 | 6/1887 | Hoffman | 401/83 X |
| 1,355,026 | 10/1920 | Austin | 401/280 X |
| 2,369,224 | 2/1945 | Ferger | 401/54 X |
| 2,428,960 | 10/1947 | Cloutier | 401/217 |
| 2,500,979 | 3/1950 | Dark | 401/117 X |
| 3,205,863 | 9/1965 | Rhoades | 401/216 X |
| 3,972,630 | 8/1976 | Schenk | 401/217 |

*Primary Examiner*—Edgar S. Burr
*Assistant Examiner*—James R. Feyrer
*Attorney, Agent, or Firm*—Barlow & Barlow

[57] ABSTRACT

A writing instrument in which a marking element is removably mounted in a casing and held in the casing by resilient means acting lengthwise of the writing instrument. A removable plug at one end of the casing holds the removable marking element under compression in the casing.

2 Claims, 7 Drawing Figures

WRITING INSTRUMENT

BACKGROUND OF THE INVENTION

There have been several arrangements for retaining removable marking elements in writing instrument casings. For example, there is the very familiar push top mechanism in which a marking element is received within an outer casing, the marking element having a compressible spring along the writing end thereof which bears against the writing tip end of the casing, the top end of the marking element engaging a cam arrangement in the top portion of the unit. The top casing and the bottom casing are generally separable at a median longitudinal point thereof and when the parts are disassembled for replacing the marking element, the marking element freely falls out along with the spring in such a way that the spring can easily be lost and the parts become completely disassociated from each other. There is also in the prior art an arrangement wherein a writing instrument casing retains a marking element without the use of a spring at the writing point end thereof, but indeed captures a spring in the retaining cap portion so that the same resiliently engages the end of the marking element and forces it out through the writing point. The Hoffman U.S. Pat. No. 365,747, for example, shows a top member which is spring-loaded axially outward and may be depressed against the resilient spring to force the writing implement outward. The Biro U.S. Pat. No. 2,491,082 is another example where the lower end of the marking implement is resiliently held inwardly of the writing tip and may be forced outwardly again by a top member that presses the same downwardly and holds it into latched position. In addition, there is the propel-repel type of mechanism in which a marking element is threadingly engaged with an inner reciprocating sleeve and which does not need any resilient element to retain the marking element in position since the marking element is physically fastened by the threaded joint. The instant invention improves upon these prior art constructions by providing a positive lock for retaining the marking element within the writing instrument casing, while at the same time permitting easy replacement thereof.

SUMMARY OF THE INVENTION

In accordance with the invention a writing instrument with a casing is provided, and within the casing is located a cylindrical sleeve that is secured therein and protrudes from the rear free end of the lower end of the casing. Surrounding the free end of the casing that protrudes from the lower end is an upper casing portion or a cap casing. A marking element is secured within the cylindrical sleeve in a fashion whereby the same may be slid therein and easily removed therefrom, being retained in position by a resilient cap-like member or plug, spring means acting on the marking element in a longitudinal direction to snugly hold the marking element in the cylindrical sleeve against an abutment surface. The invention takes a variety of forms in which removable plugs are either screw-threaded into the free end of the cylindrical sleeve or received in bayonet slots and the spring means can be located either within the plug or at the lower end of the cylindrical sleeve near the conical or writing end of the instrument.

A primary object, therefore, of the instant invention is to provide a writing instrument having an inner cylindrical sleeve into which may be easily inserted and removed a marking element which the entire writing instrument carries as a unit thereof, the writing instrument being constructed so that interchangeable marking elements may be readily received and held in position.

A still further object of the invention is to provide a writing instrument which will be formed with a few strong, simple and durable parts and which would be inexpensive to manufacture and will not easily get out of order as there will be a minimum number of rotating and/or movable parts.

DESCRIPTION OF THE PREFERRED EMBODIMENT

Figures 1, 2, 3, 4, 5, 6, 7:
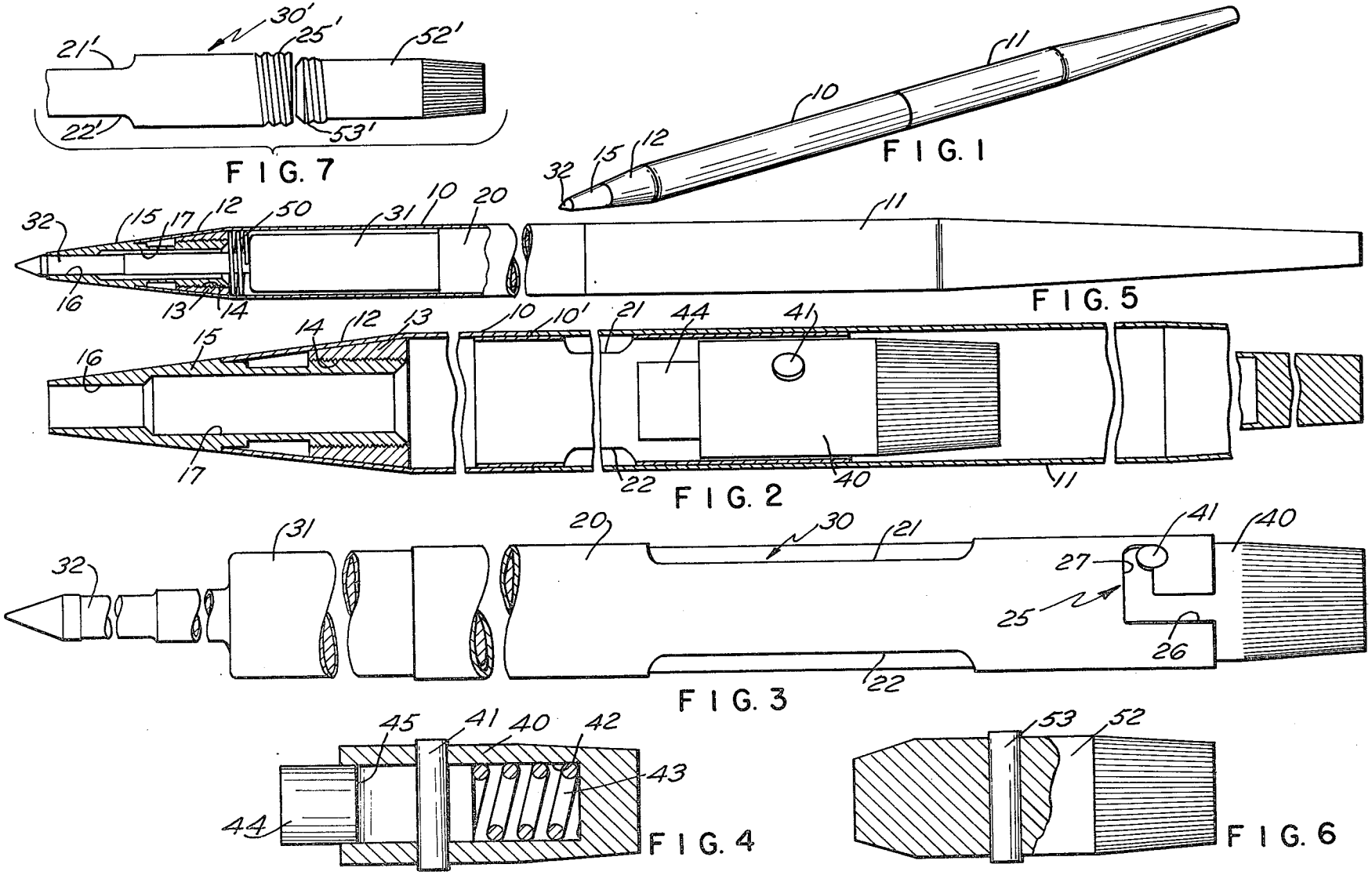
FIG. 1 is a perspective view of a writing instrument embodying the invention.
FIG. 2 is a detached sectional view thereof.
FIG. 3 is an elevational view of the internal sleeve.
FIG. 4 is a sectional view of an end plug for the version of FIG. 2.
FIG. 5 is a partial sectional view of a modified writing end of the writing instrument.
FIG 6 is a sectional view of a modified plug for use in the modified version.
FIG. 7 is a detached partial elevational view of a further modified internal sleeve and plug therefor.

Proceeding with the invention, there is disclosed an outer casing of two parts, namely a lower section 10 and an upper section 11. The inwardly tapered lower section 12 has fitted therein a point bushing 13. The point bushing is provided with a threaded inner bore 14 and threadingly received therein is a point 15 which is provided with a stepped inner bore consisting of a lower end portion 16 and an upper enlarged portion 17.

A sleeve 20 as seen in FIG. 3 is frictionally and/or adhesively secured within the lower section 10 in such a way that a considerable portion thereof protrudes above the upper end of the lower section 10 which terminates at 10' (see FIG. 2). The sleeve 20 is provided with two cutout portions 21 and 22 that are diametrically oriented to each other and the upper end of the sleeve is provided with diametrically opposed bayonet pin receiving slots generally designated 25 (only one being shown) and which consists of an axial or longitudinal slot 26 and a partial circumferential slot portion 27 with a detent for receiving a pin or the like.

Received within the sleeve 20 is a marking element or cartridge 30 which comprises a cylindrical portion for holding the ink designated 31 and a point portion 32. The cylindrical portion 31 protrudes outwardly of the cutout portions 21 and 22 of the sleeve 20 in such a way that it may be grasped by the fingers and moved inwardly or outwardly as one desires. The lower portion 32 which provides the point or actual marking implement, which is sometimes known in the art as the feed tube, extends from the reservoir or enlarged portion 31 of the marking element received in the bores 16 and 17 of the point 13.

In order to retain the marking element within the sleeve there is disclosed in FIG. 4 a first form for accomplishing this consisting of a closure plug 40 with a transverse pin 41 therein. The plug 40 is provided with an inner bore 42 which receives a compression spring element 43 and slidably receives a presser member 44 which is provided with a transverse slot therein 45. The arrangement is such that the spring 43 normally urges the presser portion 44 outwardly of the closure 40 to the extent as shown in FIG. 4, while reverse pressure to the right as viewed in the drawing will push the presser member upwardly into the bore 42 against the compression spring 43. Referring again to FIG. 3 the closure member 40 is seen engaged with the cylindrical sleeve 20 so that the pin 41 as passed downwardly into the bayonet pin recess 25 and over into the transverse portion 27 thereof where it may be retained.

Referring now to FIG. 5 there is shown a modified form of the invention in which a compression spring 50 is placed against the point bushing 13 and suitably retained within the lower casing 10 by various means such as enlarging the diameter of at least one convolution of the spring. There are no other changes made to the construction except, as seen in FIG. 6, the closure plug 52 is a solid plug with a transverse pin 53 passing therethrough which engages the bayonet slot 25 in the sleeve.

Referring to FIG. 7 there is illustrated a further modification in which the means for fastening the plug into the sleeve is altered. The casing 30' is provided with cutout portions 21', 22' and the free or upper end thereof has helical screw threads 25' rolled therein. The plug 52' is provided with mating threads 53' that permit the plug to be screw threaded into the sleeve. The plug 52' may have the solid construction of FIG. 6 in which a spring means as seen in FIG. 5 would be used, or alternately, if the plug has a resiliently urged member as seen in FIG. 4, the writing instrument lower end will be as seen in FIG. 2.

It will be seen that the improved writing instrument of the instant invention comprises a tubular body that is provided with a point and an inner sleeve, the sleeve slidably receiving a marking element in the form of an ink reservoir with an ink feeder which terminates in a writing tip. The marking element is held within the writing instrument and particularly the lower portion thereof by means of a plug which plug engages a bayonet slot receiving means at the upper and free end of the sleeve, or is fastened in other manners, the marking element being resiliently held within the lower end of the writing instrument by a longitudinal or axial spring action. It will be apparent that the marking element or writing cartridge may be readily removed by and replaced by removing the retaining plug and then may be grasped through apertures that are provided in the protruding portions of the inner sleeve. When the writing element is in place and retained by the plug, the cap member such as 11 may be placed thereover which provides a finished unit.

I claim:

1. A writing instrument having a casing, a marking element, the forward end of the casing having a conical point with a bore therethrough for passage of the marking element, a cylindrical sleeve secured in the casing and having a free end protruding from the casing, said free end being provided with a bayonet pin receiving slot, a cylindrical plug provided with a radially protruding pin for insertion into the bayonet slot, a compression spring in the plug acting on the marking element in a longitudinal direction to snugly hold the marking element in the sleeve against an abutment surface, said radially protruding pin extending across said plug confining said spring in said plug.

2. A writing instrument as in claim 1 wherein said spring in the plug includes a slotted presser member straddling said radially protruding pin in said plug and sliding relative thereto.

* * * * *